US005752661A

United States Patent [19]

Lewis

[11] Patent Number: 5,752,661

[45] Date of Patent: May 19, 1998

[54] MOTORIZED PUMP BACKPACK LIQUID SPRAYER

[76] Inventor: Kit R. Lewis, P.O. Box 23, Duke, Okla. 73532

[21] Appl. No.: 669,745

[22] Filed: Jun. 26, 1996

Related U.S. Application Data

[60] Provisional application No. 60/000,998 Jul. 10, 1995.

[51] Int. Cl.[6] ..... B67D 5/64

[52] U.S. Cl. ..... 239/153; 239/154; 239/332; 222/175

[58] Field of Search ..... 239/152–154, 239/332; 222/175; 224/153

[56] References Cited

U.S. PATENT DOCUMENTS

| | | | |
|---|---|---|---|
| 2,575,936 | 11/1951 | Andrews | 222/175 |
| 3,040,471 | 6/1962 | Blase | 239/152 |
| 3,421,697 | 1/1969 | Marks | 239/152 |
| 3,758,036 | 9/1973 | Bauder et al. | 239/102 |
| 4,362,307 | 12/1982 | Nakatani | 224/153 |
| 4,651,903 | 3/1987 | Pagliai | 222/175 |
| 4,801,088 | 1/1989 | Baker | 239/152 |
| 4,848,660 | 7/1989 | O'Connell | 239/154 |
| 5,150,837 | 9/1992 | Ferrari | 239/153 |
| 5,335,853 | 8/1994 | Wirz | 239/154 |
| 5,429,306 | 7/1995 | Schneider et al. | 239/154 |
| 5,460,307 | 10/1995 | Stevenson | 224/153 |

*Primary Examiner*—J. Casimer Jacyna
*Attorney, Agent, or Firm*—Robert K. Rhea

[57] ABSTRACT

A liquid spaying apparatus is formed by a molded plastic generally rectangular container having a forward surface contoured for contacting the back of a user in backpack fashion. A wheel and axle assembly secured to the forward lower portion of a container support panel in cooperation with a handle on the container permits movement of the apparatus in two wheel dolly fashion. An on board battery drives a motor/pump assembly for spraying liquid through a manually controlled wand.

4 Claims, 3 Drawing Sheets

MOTORIZED PUMP BACKPACK LIQUID SPRAYER

This application claims the benefit of U.S. Provisional Application Ser. No. 60/000,998, filed Jul. 10, 1995.

BACKGROUND OF THE INVENTION

1. Field of the Invention

This invention relates to vegetation sprayers and more particularly to a motor driven pump sprayer which may be carried in backpack fashion or moved in two wheel dolly fashion.

2. Description of the Prior Art

Sprayers intended for dispensing liquid, such as fertilizers, insecticides, disinfectants, or pest exterminating and other residential or agricultural type treatments, normally include a reservoir for the liquid to be sprayed.

These sprayers are usually designed for portability such as being hand carried or supported by one shoulder strap or on the back in a backpack manner in which a pair of straps secured to the reservoir contact the forward portion of the shoulders of the user. These sprayers are usually provided with a pump for dispensing the liquid. In the relatively small volume sprayers, the pump is contained by the container with a handle projecting through its fill opening and manually operated for pressurizing the interior of the container and forcing the liquid through a manually controlled wand.

Such sprayers containing a greater volume of liquid are sometimes provided with a manually operated lever operating a pump to pressurize a chamber within the reservoir and force the fluid through a manually controlled wand. Other sprayers are provided with a battery operated pump either for pressurizing an internal tank or directly pumping the fluid through the spray wand. Some such sprayers even include an internal combustion engine performing the functions of the battery driven motor.

U.S. Pat. No. 4,651,903 issued Mar. 24, 1987 to Pagliai for MOTORIZED PUMP PRESSURIZED LIQUID SPRAYER is an example of the internal pressurized tank type of sprayer. This patent is principally directed toward a retrofitting unit replacing the manually operated lever for pressurizing the internal tank.

U.S. Pat. No. 4,801,088 issued Jan. 31, 1989 to Baker for PORTABLE BATTERY POWERED SPRAYER is another example of a portable back carried sprayer operated by rechargeable batteries in which one battery may be carried by the user.

U.S. Pat. No. 4,848,660 issued Jul. 18, 1989 to O'Connell for APPARATUS FOR CARRYING A SUPPLY OF LIQUID is believed a good example of the further state-of-the-art disclosing a relatively small backpack container of liquid.

U.S. Pat. No. 3,421,697 issued Jan. 14, 1969 to Marks for SPRAYING EQUIPMENT and U.S. Pat. No. 3,758,036 issued Sep. 11, 1973 to Bauder et al for SPRAYING APPARATUS are examples of backpack carried sprayers utilizing an internal combustion engine as a power source for pressurizing or dispensing the liquid.

This invention is believed distinctive over the above patents by providing a light weight liquid reservoir contoured for contacting the back of a user when supported as a backpack including a motor, battery, and pump disposed below the reservoir and further includes a pair of wheels and a handle for moving the sprayer about on the surface of the earth in two wheel dolly fashion, as for example, when the container is full of liquid and it is desired to reduce the mass thereof before being carried in backpack fashion.

SUMMARY OF THE INVENTION

A preferred embodiment the sprayer includes a generally rectangular container molded from plastic material having one surface contoured for cooperatively contacting the back of a user while being carried. The bottom wall of the container having a central depending sump portion intersecting a vertical panel forming a container support. A pump/motor is mounted on the support panel at one side of the sump. A storage battery is mounted on the support panel adjacent the other side of the sump and connected with the motor by wiring through a toggle switch. Tubing connects the sump with the pump inlet port and the pump outlet port with a manually held sprayer wand. An inspection cover and container housing shields the motorized pump and battery and forms a portion of the container support when the container is in upright position.

An axle journalling a pair of wheels, at respective sides of the container supporting panel, extends horizontally through an axle support on the forward surface of the support panel near its depending limit. An inverted U-shaped handle having parallel legs are slidable in sleeves secured to the side walls of the container for extending the handle beyond the container top and manually moving the sprayer in two wheel dolly fashion.

The principal object of this invention is to provide a power driven sprayer which may be carried in backpack fashion or push/pulled in two wheel dolly fashion.

DESCRIPTION OF THE PREFERRED EMBODIMENTS

Like characters of reference designate like parts in those figures of the drawings in which they occur.

Figure 1:
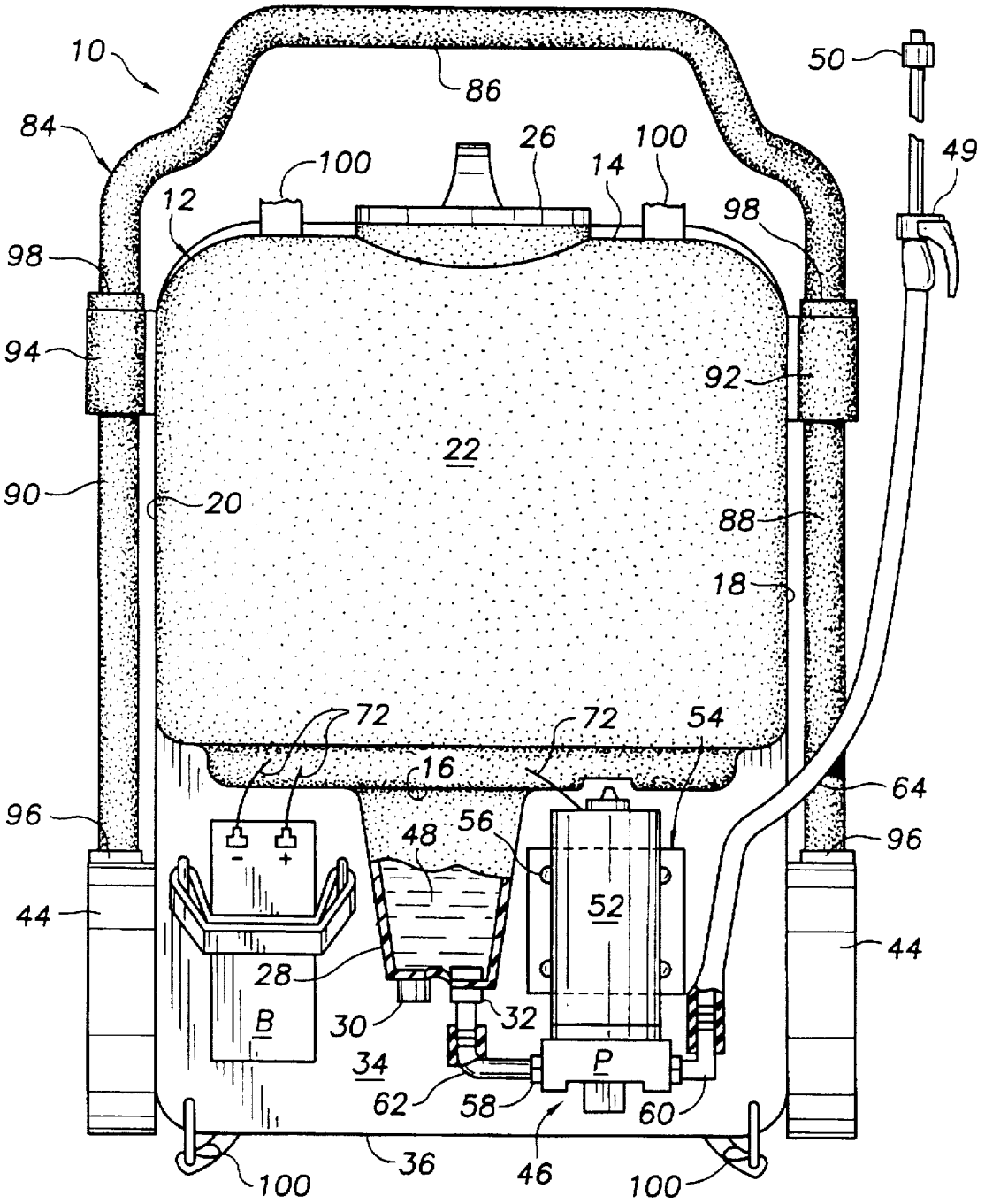
FIG. 1 is a front elevation view partially in section, with the cover/housing removed for clarity.

The reference numeral 10 indicates the sprayer which is upright rectangular in general configuration. The sprayer 10 comprises a molded plastic material fluid container or tank 12 of selected capacity, for example, 12 to 20 liters (3 to 4¾ gallons) having a top wall 14, a bottom wall 16, opposing side walls 18 and 20, a rearward wall 22, and a concave forward wall 24 contoured for abutting relation with the back of a user when carried. The top wall has an opening normally closed by a filler cap 26 which admits air in the manner conventional with the fuel tank cap of an internal combustion engine. The bottom wall 16 is centrally provided with a depending sump 28 having an outlet normally closed by drain cap 30 and having a liquid dispensing fitting 32 for the purpose presently explained. The container bottom wall 16 is integrally joined with a depending vertical support panel 34 which projects laterally in either direction from opposite sides of the sump, as viewed in FIG. 1, coextensive with the vertical plane defining the lateral limit of the respective side wall 18 and 20 of the container and extends downwardly a predetermined dimension, terminating in a horizontal support edge 36 spaced below the depending limit of the sump 28. An axle support 40 on the forward surface of the support panel extends forwardly and downwardly from opposite sides of the sump 28 terminating in a horizontal support portion in the plane of the bottom surface 36 of the support panel 34, as at 38.

An axle 42 extends horizontally through the axle support 40 and journals a pair of wheels 44 at respective sides of the sprayer. Motor driven pump means 46 is mounted on the rearward surface of the support panel 34 to dispense fluid 48 from the container 12 through a control valve 49 and a spray nozzle 50. The motor driven pump means 46 comprises a pump P and a motor 52 having its base 54 secured to the support panel 34 by bolt nut and means 56. The pump P having inlet and outlet fittings 58 and 60 in its respective inlet and outlet ports. Tubing 62 connects the sump outlet fitting 32 with the pump inlet fitting 58 and other tubing 64 connects the pump outlet fitting 60 with the control valve and spray nozzle.

Figure 4:
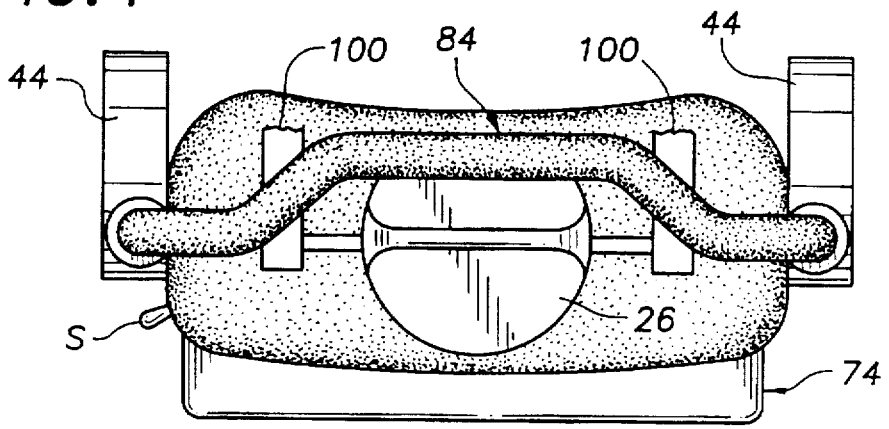
FIG. 4 is a top view of FIG. 1 with the wand removed.
Figure 5:
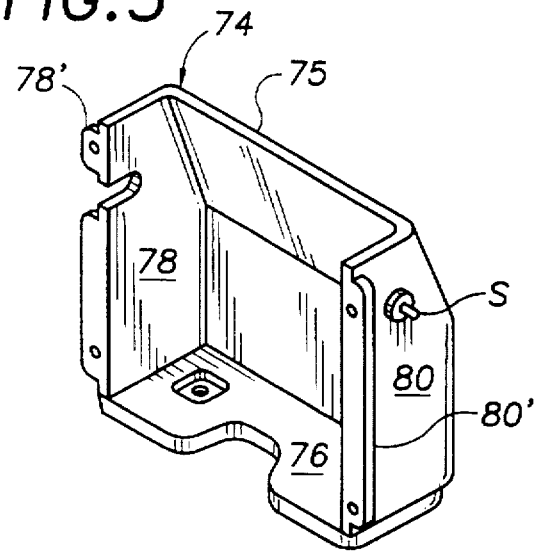
FIG. 5 is a perspective view of the inspection cover/housing, per se.

A battery B is mounted on the rearward surface of the support panel 34 opposite the motor 52 with its terminals 68 and 70 connected by wiring 72 with the motor 52 through a control switch S (FIGS. 4 and 5) for energizing and deenergizing the motor and pump P.

Figure 2:
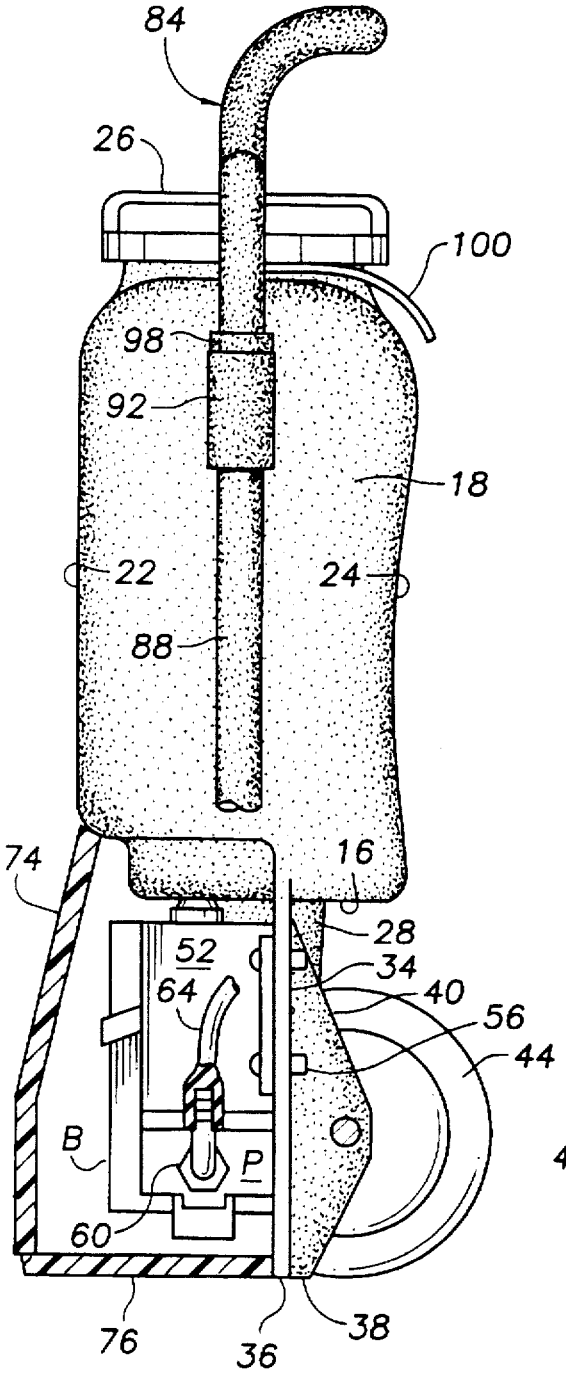
FIGS. 2 and 3 are right and left side elevation views, respectively, partially in section, with parts broken away for clarity.
Figure 3:
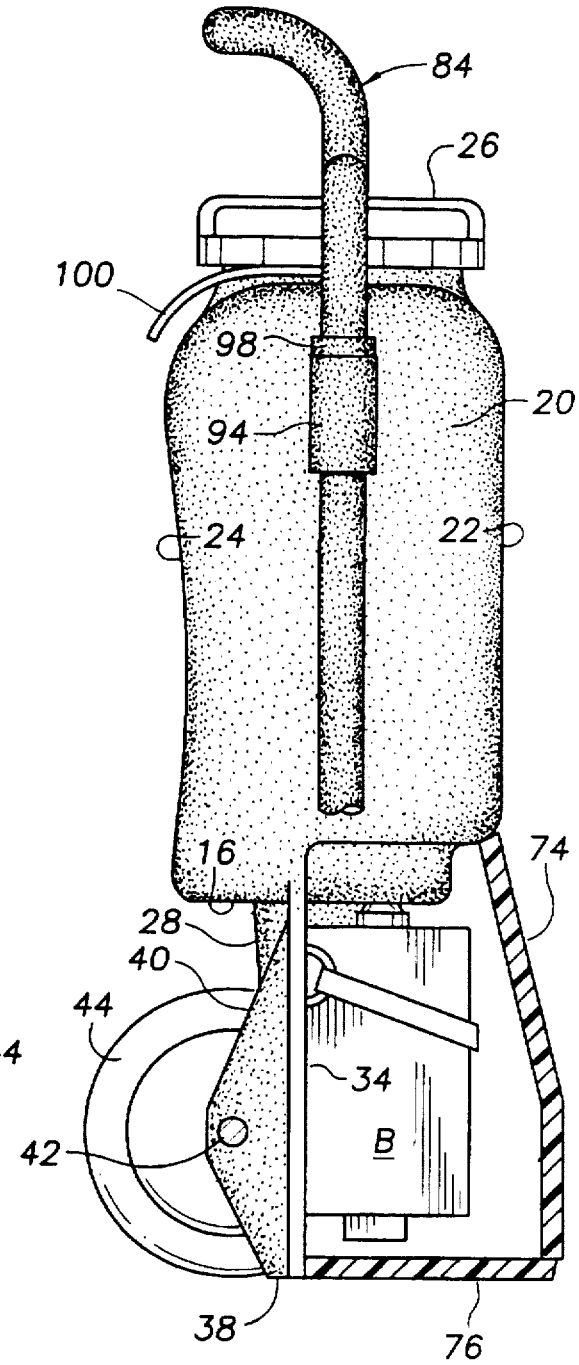

An equipment inspection cover or shield and housing support wall-like unit 74 includes a bottom wall 76, lying in the plane of the depending limit 36 of the support panel 34 and axle support portion 38, and opposing upstanding side walls 78 and 80 spaced apart substantially equidistant with the lateral limit of the container 12. Flanges 78' and 80' on the forward edges of the housing walls secure the housing by screws 79, or the like, with the rearward lateral surfaces of the support panel 34. The rearward edges of the housing bottom 76 and walls 78 and 80 are integrally joined with a housing back or rearward wall 75 which abuts and depends vertically and angularly rearward and downwardly from the plane of the container rearward wall 22. As more clearly illustrated by FIGS. 2 and 3 the housing bottom wall 76 cooperates with the depending limit or edge 36 of the support panel 34 and axle support portion 38 and supports the sprayer in an upright position.

Handle means 84 comprising an inverted U-shaped tubular handle having a bight portion 86 and opposing parallel legs 88 and 90, straddling the respective sides of the container 12, are slidably received vertically by a pair of sleeves 92 and 94 respectively secured to the upper limit of the container sides 18 and 20. A pair of collars 96 secured to the depending end portion of the respective handle leg 88 and 90 limit upward movement of the handle and similarly a second pair of collars 98 secured to the respective handle leg, intermediate its ends, limits downward movement of the handle. A pair of backpack straps 100 are connected at one end with the upper limit of the container 12 on opposite sides of the filler cap 26 and at their other ends with the depending limit of the support panel 34.

OPERATION

Operation of the sprayer seems obvious when constructed and arranged as described hereinabove. Briefly stated the container 12 is filled with a selected quantity of the liquid 48 to be sprayed through the nozzle 50. If the sprayer is to be carried, the backpack straps 100 are placed over the shoulders of the user. With the sprayer surface 24 contacting his back and holding the sprayer wand in his hand the user closes the switch S, energizing the motor and pump P which forces the liquid through the tubing 64 under control of the valve 49 while the sprayer nozzle is directed toward an object to be sprayed.

Figure 6:
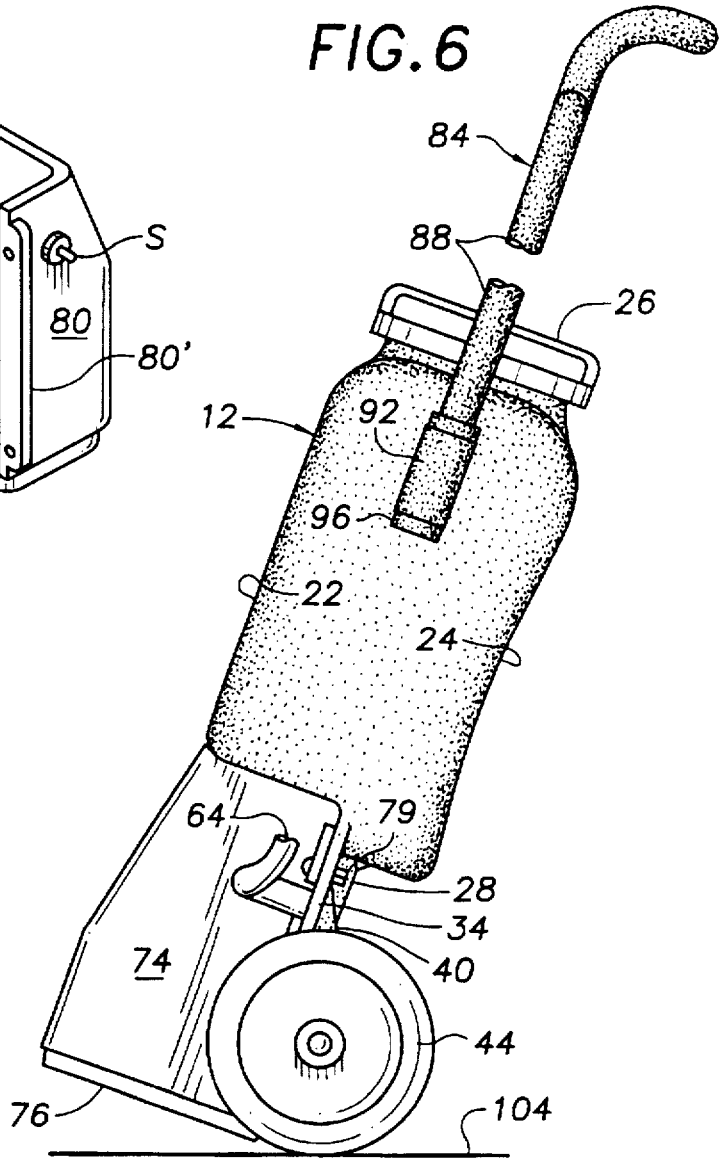
FIG. 6 is a side elevation of the sprayer in two wheel dolly position.

Alternatively the sprayer may be moved from place to place for spraying by extending the handle means 84, as illustrated by FIG. 6, and tilting the sprayer in a forward direction so that its platform support surface 76 clears the surface of the earth, indicated at 104, allowing the sprayer 10 to be manually pulled or pushed in two wheel dolly fashion from one location to another.

Obviously the invention is susceptible to changes or alterations without defeating its practicability. Therefore, I do not wish to be confined to the preferred embodiment shown in the drawings and described herein.

I claim:

1. A portable spraying apparatus, comprising;

a substantially rectangular molded liquid single compartment container having opposing forward and rearward, side, top and bottom walls, said forward wall having a concave surface, generally vertical when in use, contoured for abutting relation, when carried, on the back of a user, said top wall having a cap closed filler opening;

a liquid receiving sump depending from said bottom wall;

a container support panel, coextensive with the spacing between said side walls, vertically depending from said bottom wall on opposite sides of said sump, said support panel having a horizontal support edge;

a motor driven pump secured to the rearward surface of said support panel, said pump having an inlet port communicating with said sump and having an opposite outlet port;

a manually operated liquid spraying wand connected with the outlet port;

a storage battery supported by the rearward surface of said support panel and operatively connected with said motor for driving said pump;

a container support housing secured to said support panel for shielding said battery and said motor driven pump, said housing comprising a back panel and side panels respectively depending from said container back wall and side walls;

a housing bottom panel underlying said housing back panel and side panels;

an axle support projecting forwardly and downwardly from the lowermost portion of said support panel and terminating in a horizontal support portion in the plane of the support panel support edge;

an axle horizontally supported by said axle support;

a pair of wheels journaled by respective end portions of said axle; and, an inverted U-shaped handle having legs slidably supported on respective sides of said container for manual mobile movement of said apparatus on a supporting surface in two wheel dolly fashion.

2. A portable spraying apparatus for carrying on the back of a user, comprising;

a molded liquid single compartment container having opposing forward and rear ward, side, top and bottom walls, said forward wall having a concave surface, generally vertical when in use, contoured for abutting relation, when carried, on the back of a user, said top wall having a cap closed filler opening;

a liquid receiving sump depending from said bottom wall;

a container support panel, coextensive with the spacing between said side walls, vertically depending from said bottom wall on opposite sides of said sump, said support panel having a horizontal support edge;

a motor driven pump secured to said support panel, said pump having an inlet port communicating with said sump and having an opposite outlet port connected with a liquid spraying wand;

a storage battery supported by the said support panel and operatively connected with said motor for driving said pump.

3. The spraying apparatus according to claim 2 and further including;

a container support housing secured to said support panel for shielding said battery and said motor driven pump, said housing comprising a back panel and side panels respectively depending from said container back wall and side walls; and, a housing bottom panel underlying said housing back panel and side panels for supporting said container, in combination with said support panel, in a vertically upright position.

4. The spraying apparatus according to claim 3 and further including;

a two wheel axle assembly including a pair of wheels secured to and projecting forwardly from the lowermost portion of said support panel for supporting said spraying apparatus above the surface of the earth when inclined forwardly from the vertical; and, handle means secured to said container for mobile movement of said spraying apparatus in two wheel dolly fashion.

* * * * *